US011549219B2

(12) United States Patent
Karpala

(10) Patent No.: US 11,549,219 B2
(45) Date of Patent: Jan. 10, 2023

(54) FASTENING SYSTEM FOR FASTENING A RAIL

(71) Applicant: SIKA TECHNOLOGY AG, Baar (CH)

(72) Inventor: Maciej Karpala, Skawina (PL)

(73) Assignee: SIKA TECHNOLOGY AG, Baar (CH)

( * ) Notice: Subject to any disclaimer, the term of this patent is extended or adjusted under 35 U.S.C. 154(b) by 471 days.

(21) Appl. No.: 16/605,921

(22) PCT Filed: Apr. 18, 2018

(86) PCT No.: PCT/EP2018/059851

§ 371 (c)(1),
(2) Date: Oct. 17, 2019

(87) PCT Pub. No.: WO2018/192949

PCT Pub. Date: Oct. 25, 2018

(65) Prior Publication Data

US 2020/0270818 A1 Aug. 27, 2020

(30) Foreign Application Priority Data

Apr. 19, 2017 (EP) ..... 17166969

(51) Int. Cl.

| | |
|---|---|
| ***E01B 9/62*** | (2006.01) |
| ***E01B 9/42*** | (2006.01) |
| ***E01B 9/60*** | (2006.01) |
| ***E01B 9/68*** | (2006.01) |

(52) U.S. Cl.
CPC ..... *E01B 9/62* (2013.01); *E01B 9/42* (2013.01); *E01B 9/60* (2013.01); *E01B 9/68* (2013.01); *E01B 2204/01* (2013.01)

(58) Field of Classification Search
CPC ..... E01B 9/42; E01B 9/60; E01B 9/62; E01B 9/68; E01B 2204/01
See application file for complete search history.

(56) References Cited

FOREIGN PATENT DOCUMENTS

| | | | | |
|---|---|---|---|---|
| DE | 1 204 697 | B | 11/1965 | |
| EP | 2 180 096 | A2 | 4/2010 | |
| FR | 2 899 605 | B1 | 6/2008 | |
| WO | 2005/108675 | A1 | 11/2005 | |
| WO | 2013/091590 | A2 | 6/2013 | |
| WO | WO-2013091590 | A2 * | 6/2013 | ..... E01B 9/38 |

OTHER PUBLICATIONS

Jul. 25, 2018 International Search Report issued in International Patent Application No. PCT/EP2018/059851.
Jul. 25, 2018 Written Opinion of the International Searching Authority issued in International Patent Application No. PCT/EP2018/059851.

* cited by examiner

*Primary Examiner* — Robert J McGarry, Jr.
(74) *Attorney, Agent, or Firm* — Oliff PLC

(57) ABSTRACT

A fastening system for fastening a rail for rolling stocks such as trains, including a base plate, an elastic material and a rigid casing, wherein the base plate is embedded in the elastic material and the elastic material is arranged, at least partially, between the base plate and the rigid casing.

16 Claims, 3 Drawing Sheets

FASTENING SYSTEM FOR FASTENING A RAIL

TECHNICAL FIELD

The invention relates to a fastening system for fastening a rail for rolling stocks such as trains, a fastening and support system for fastening and supporting a rail for rolling stocks such as trains, a rail system, a method of producing a fastening system for fastening a rail for rolling stocks such as trains, a method of producing a fastening and support system for fastening and supporting a rail for rolling stocks such as trains, a method of producing a rail system and a use of a fastening system and/or a fastening and support system.

TECHNICAL BACKGROUND

In the prior art, different solutions for fastening a rail to the ground are known. For example, such fastening systems comprise a discrete fixation or a floating base plate. Such known solutions use anchor devices for connecting the rail and fastening system to the ground. On ballast-less tracks, such anchor devices may connect the rails on a concrete surface. On steel support structures, anchoring screws are used. In general, the known fixations are considered as being improvable with respect to their adaption to the requirements in use.

WO 2013/091590 A2 discloses a sole plate assembly for fixation of rails. A baseplate is equipped with a recession, housing a flexible inter-plate, covering the bottom and sidewalls of the recession, while the flexible inter-plate houses a distribution plate. WO 2005/10675 A1 discloses a rail fastening assembly having a top plate for supporting the underside of a rail on a canted surface extending between two, spaced, locating mounds. The top plate locates within a cavity of an elastomeric boot fitted into a socket of a bottom plate. Parts of the bottom plate are swaged or cramped. The boot and the top and bottom plates are separate items which are held together solely by the above-mentioned parts of the bottom plate.

DE 1 204 697 describes a rail mounting having two horizontal plates being separated by an intermediate layer of rubber-elastic material. The rail is fixed to an upper plate.

SUMMARY

It is an object of the present invention to propose a fastening system, a fastening and support system, a rail system, a method of producing a fastening system, a method of producing a fastening and support system and a method of producing a rail system, wherein a variable fixation of the rail to the ground, in particular with a well-adapted support structure, is achieved.

According to a first aspect of the present invention, a fastening system for fastening a rail for rolling stocks such as trains is proposed, comprising a base plate, an elastic material and a rigid casing wherein the base plate is embedded in the elastic material and the elastic material is arranged, at least partially, between the base plate and the rigid casing.

A core idea of the invention is the embedment of the base plate in the elastic material, wherein the elastic material as such is arranged in a rigid casing. As a consequence, the fastening system can be variably used, e.g. as a fastening for sleepers in ballasted tracks and/or for non-ballasted tracks. In particular, the fastening system can be variably fixed to the ground or supporting structure respectively, e.g. screwed onto a (concrete) structure or embedded within a (concrete) structure or glued onto a (concrete) structure or similar. The system may be applied with at least one (in particular at least two or at least three or at least four) anchor devices or without anchor devices. The number of optional anchor devices may be adapted to axle load and speed of the vehicle using the rail. In particular, if no anchor devices are used, the fastening system can be embedded (cast) in (fresh) concrete. It could be also glued to an existing (steel or concrete) surface. Moreover, the fastening system may provide higher resistance with respect to lateral forces. Moreover, the fastening system may result in a better distribution of loads (in particular because of a non-linear support which could be adapted for different types of trains). In general, the fastening system can be combined with existing fastening systems (steel plates with clamps etc.) in particular of larger construction projects (also in the main line of a railway). In embodiments, the fastening systems can be used for light and/or heavy trains and/or tramways and/or underground trains.

The elastic material may consist of one homogeneous material (having in particular one constant e-modulus). However, in embodiments, the elastic material may comprise several (at least two or at least three or at least four) portions or zones, optionally with different elastic properties, in particular a different e-modulus.

Preferably, the elastic material comprises several portions or zones, preferably with different elastic properties, further preferably with a different e-modulus, preferably wherein a first zone being at or closer to an inner side of the system (i.e. a side which faces a centre of the track) is softer and/or has a lower e-modulus than a second zone being at or closer to an outer side of the system (i.e. a side which is facing away from the centre of the track).

There may be more than two, e.g. at least three or at least four different zones, preferably having a different stiffness and/or a different e-modulus. In such a case, preferably, the different zones are arranged so that the zone having the lowest stiffness and/or e-modulus is arranged at or close to the inner side and, successively, each further zone has an increased stiffness and/or e-modulus, increasing in the direction from the inner to the outer side. Within the fastening system for fastening a rail, the inner side can be defined by a sloped supporting surface for the rail (i.e. sloped portion of the baseplate), in particular such that the supporting surface is lower at the inner side. If the respective inner (first) portion of the elastic material is softer (and/or has a lower e-modulus) than any outer portion, a reliable support of the rail can be achieved. Moreover, the support (i.e. by correspondingly adapting the elastic material and its different zones), can be variably modified to a specific application.

The e-modulus of the elastic material is preferably of less than 20 GPa, preferably less than 5 GPa, further preferably less than 1 GPa, further preferably less than 0.1 GPa. The "e-modulus" is an abbreviation for the elastic modulus (Young's modulus), in particular at 20° C. Moreover, the e-modulus may be higher than 0.01 GPa, in particular higher than 0.001 GPa. If the elastic material comprises several portions (zones) with different e-moduli, the values above may be considered as relating to the portion (zone) with the highest e-modulus (regarding the upper limit) or the lowest e-modulus (regarding the lower limit). The limits above may also be considered as average values wherein each portion (zone) contributes with its weight in the calculation of the average so that for example an elastic material having one portion with an e-modulus of 1 GPa and a weight of 1 g and a second portion having an e-modulus of 2 GPa and a weight of 2 g is calculated as (1 GPa*1 g+2 GPa*2 g)/3 g=(5/3) GPa or 1.67 GPa. The elastic material may comprise (preferably to at least 50%) a plastic and/or polymeric and/or elastomeric material. Preferably, the elastic material comprises (in particular to at least 50%) a polyurethane component. In an embodiment, the elastic material is entirely made of polymer, in particular polyurethane. If the elastic material consists of regions (portions or zones) with different e-modulus, the e-modulus of the maximum e-modulus may be less than 20 times, preferably less than 10 times, further preferably less than 5 times the minimum e-modulus (of the material with the lowest e-modulus among the several zones). On the other hand, the maximum e-modulus may be at least 1.1, preferably at least 1.5, further preferably at least 2 times the e-modulus of the minimum zone (or region or portion).

The elastic material may comprise one or two of the following materials according to group I, and/or II.

Group I: Static stiffness determined analogous to DIN 45673-1 (2016). Test specimen dimensions 360×160×25 mm. Range of this parameter should be between c=53-222 kN/mm, determined as per the secant method between 17 and 68 kN and c=29 kN/mm, determined as per the secant method between 8 and 32 kN. Tolerance of the parameters +/−20%

Group II: Static stiffness determined analogous to DIN 45673-1 (2016). Test specimen dimensions 1000×180×25 mm. Range of this parameter should be between c=31-63 kN/mm, determined as per secant method between 8 and 32 kN. Tolerance of the parameters +/−20%

In particular, in case of an embedding of the fastening system within concrete, it is preferred to seal a (vertical) connection between the fastening system and the concrete, in particular with respect to moisture. A product for over-sealing may be:

Group III: Secant tensile modulus 0.6 N/mm2 (approx.) at 100% elongation (CQP 020-1, ISO 8339; 2016). 1.1 N/mm2 (approx.) at 100% elongation (−20° C.). Tolerance of parameters +/−20%.

The material of the rigid casing may have an e-modulus of at least 100 GPa, further preferably at least 200 GPa (and/or less than 2000 GPa, preferably less than 1000 GPa). Also the rigid casing may be formed of regions (zones or portions) having a different e-modulus. In such a case, the values above may be considered as values for the portion (zone) with the highest e-modulus (in case of an upper limit) or the lowest e-modulus (in case of a lower limit). Moreover, the values above may be considered as average values, wherein the calculation of the average value is dependent on the weight of each portion having a certain e-modulus such that for example a rigid casing comprising two different portions (with different e-modulus), namely a first portion with an e-modulus of 100 GPa and a weight of 1 kg and second portion with a e-modulus of 200 GPa and a weight 200 kg results in an average e-modulus of 167 GPa. In particular, the rigid casing may comprise (or may be formed of) metal, in particular steel.

The base plate may have an (approximately) quadrangular, in particular a parallelogram or a rectangular shape. Longitudinal edges of the base plate may have a length which is between 0.2 and 2, preferably between 0.3 and 1 times the length of the transversal edges of the base plate. Longitudinal edges of the elastic material may have a length which is between 0.2 and 2, preferably between 0.3 and 1 times the length of the transversal edges of the base plate. Longitudinal edges of a bottom surface of the rigid casing may have a length which is between 0.3 and 3, preferably between 0.5 and 2 times the length of the transversal edges of the base plate. Longitudinal edges refer to the edges of (e.g.) the base plate which run (at least substantially) in parallel with the rail to be mounted on the fastening system (e.g. base plate). To run ("substantially") in parallel may comprise an angle of less than 45°, in particular less than 30° between the extension of the longitudinal edges and the extension of the rail to be mounted on the fastening system. The transversal edges of (e.g.) the base plate run preferably (substantially) perpendicular to the extension of the rail to be mounted on the fastening system, wherein at least "substantially" perpendicular means preferably in an angle of more than 60° with respect to the extension of the rail to be mounted on the fastening system (e.g. base plate). The base plate may be in general made of metal, in particular steel (or comprise a metal/steel component). In case of breaking forces (pull out) in the track, the base plate can be additionally equipped with anchoring elements in the concrete slab.

In a projection onto a ground surface (bottom surface) the base plate may cover at least 80%, preferably at least 90% and/or not more than 99%, preferably not more than 97% of the area covered by the elastic material. The elastic material (in such projection) may cover at least 80%, preferably at least 90% and/or not more than 99%, preferably 97% of the rigid casing (if a potentially enlarged bottom plate of the rigid casing is not considered) or at least 30%, preferably at least 45% and/or not more than 80% or not more than 65% (if a potential bottom plate of the rigid casing is considered).

The (rigid) casing may be formed as a one-piece structure, in particular as a monolithic structure. Alternatively, or in addition, the base plate may be formed as a one-piece structure, preferably monolithic structure. Alternatively, or in addition, the elastic material may be formed as a one-piece structure, preferably as a monolithic structure. If the elastic material comprises several (different) zones, at least one, several or all of these zones may be (each) formed as a one-piece structure, in particular monolithic structure.

The casing may be formed of only one material (or different materials). The (rigid) casing may be formed of only one (or different) material(s). Alternatively or in addition, the elastic material may be formed of only one (or different, in particular if there are different zones) material(s). Preferably, a "material" is to be considered as being the identical (the same) with another material, if the (chemical) composition and/or its mechanical properties (such as the e-modulus) are the same.

The (rigid) casing is preferably a fully closed box, in particular fully closed steel box.

The rigid casing may comprise a rigid bottom surface (bottom plate) and/or a first rigid frame part encasing the first edge portion of the base plate and/or at least a second frame part encasing a second edge portion of the base plate. The bottom surface (bottom plate) may extend beyond the remaining parts of the rigid casing, in particular the first and/or second rigid casing. In the longitudinal direction (along an axis of the rail to be mounted on the fastening system) such extensions may have a length of at least 5%, preferably at least 10% of the entire length of the bottom surface (bottom plate) in the longitudinal direction. In the transversal direction, such extension may have a length of at least 1%, preferably at least 3% of the overall length of the bottom surface (plate) in the transversal direction. An upper limit in the longitudinal direction may be less than 50%, preferably less than 30%. An upper limit in the transversal direction may be less than 10%, preferably less than 5%.

The first and/or second rigid frame part may encase a corresponding first/second edge portion of the base plate, preferably meaning that the corresponding edge portion faces at its lower side and its upper side and its (three) vertical sides the rigid casing. Preferably, the (three) vertical sides face three (at least substantially vertical) walls of the rigid casing. At least substantially vertical means preferably a maximum deviation from the vertical of 30°, preferably of 10°, further preferably of 2°. Such (three) walls may have at least approximately the same height. At least approximately means preferably that the height of the difference in height is not more than 20%, preferably not more than 10%, even further preferably not more than 5% of the height of the smallest wall of the (three) walls.

The first and/or second (rigid) frame part may comprise (each) an upper wall (top wall) being at least substantially horizontally arranged (preferably with a maximum deviation from the horizontal of 20°, further preferably 10°, even further preferably 5°).

The first and/or second (rigid) frame part may comprise three vertical walls and the upper wall. All three vertical walls may be (directly) connected with the upper wall. Each vertical wall may be itself planar (flat) and be angled (e.g. with an angle of 90° to the adjacent vertical wall) to the (or both) adjacent wall(s). The first and/or second (rigid) frame part may itself form a first and/or second box (together with a corresponding portion of the bottom surface (bottom plate) of the (rigid) casing). Moreover, first and/or second (rigid) frame part may allow only one open face (in particular facing in the direction of a centre of the system, i.e. in the direction of a rail to be mounted in the system).

Preferably, the elastic material comprises an elastic bottom surface (in particular elastic bottom plate) and/or a first elastic frame part encasing a/the first edge portion of the base plate and/or at least a second elastic frame part encasing a/the second edge portion of the base plate.

A (first or second respectively) edge portion of the base plate extends preferably over at least 2%, preferably at least 5%, further preferably at least 7% and/or not more than 30%, preferably not more than 20% of the transversal length of the base plate.

The elastic material may cover (contact) a lower surface of the base plate (preferably entirely). Moreover, the elastic material may cover (contact) one or two (both) longitudinal edges of the base plate (in particular entirely). The elastic material may cover one or more portions of one or two transversal edges of the base plate (e.g. at least 5% and/or not more than 10% of the respective transversal edge of the base plate). The elastic material may cover one or two portions, in particular longitudinal edge portions, of an upper surface of the base plate. The base plate may be fully (i.e. being in contact with the elastic material at a lower surface of the base plate and parts of an upper surface of the base plate and at least part of each edge) embedded by elastic material.

The rigid casing may cover a lower surface of the base plate (preferably entirely). Moreover, the rigid casing may cover one or two longitudinal edges of the base plate (in particular entirely). Moreover, the rigid casing may cover one or more portions of one or two transversal edges of the base plate. Moreover, the rigid casing may cover one or two portions, in particular longitudinal edge portions, of an upper surface of the base plate.

The rigid casing may be not in contact with the base plate or a contact area between the baseplate and the rigid casing may be less than 10%, in particular less than 1% of a surface area of the base plate facing the rigid casing.

An "edge" is preferably a portion of the base plate/elastic material/rigid casing facing side wards. An "edge portion" is preferably a portion which is adjacent to the "edge" (i.e. which directly borders the corresponding edge).

The rigid casing may cover (contact) a lower surface of the elastic material (preferably entirely). Moreover, the rigid casing may cover (contact) one or two longitudinal edges of the elastic material (in particular entirely). Moreover, the rigid casing may cover one or more portions of one or two transversal edges of the elastic material and/or cover one or two portions, in particular longitudinal edge portions, of an upper surface of the elastic material.

According to another aspect of the invention, a fastening and support system for fastening and supporting a rail for rolling stocks such as trains, is proposed, comprising the fastening system above and a support structure such as a sleeper and/or a steel and/or concrete support structure.

The rigid casing may be glued onto a surface of the support structure and/or may be embedded (in particular) in the support structure, in particular in concrete. The rigid casing may be fixed to the support structure via at least one anchoring device, in particular comprising an anchoring screw. Alternatively, the fastening system, in particular the rigid casing, may be fixed to the support structure without an anchoring device, in particular without an anchoring screw (e.g. solely by an adhesive and/or by an adhesion force due to casting the rigid casing in the support structure, in particular concrete). In any event, one and the same fastening system can be variably connected onto different support structures.

According to a further aspect of the invention, a rail system is proposed, comprising the above fastening system and/or the above fastening and support system and at least one track.

According to a further aspect of the invention, a method of producing a fastening system for fastening a rail for rolling stocks such as a train is proposed, wherein the fastening system comprises a base plate, an elastic material and a rigid casing, wherein the fastening system is preferably of the predescribed kind, wherein the method comprises: embedding the base plate in the elastic material and arranging the elastic material, at least partially, between the base plate and the rigid casing. Optionally, the base plate is, first, positioned with respect to the rigid casing and, thereafter, the elastic material is provided in between. It is also possible that the elastic material is provided in the rigid casing and (thereafter) the base plate is arranged within the elastic material.

According to a further aspect of the invention, a method of producing a fastening and support system for fastening and supporting a rail for rolling stocks such as trains is proposed, wherein the fastening and support system is in particular of the predescribed kind, having a fastening system comprising a base plate, an elastic material and a rigid casing, wherein the fastening system is preferably of the predescribed kind, comprising: embedding the base plate in the elastic material and arranging the elastic material, at least partially, between the base plate and the rigid casing and connecting the fastening system to a support structure such as a sleeper and/or a steel and/or concrete support structure.

According to a further aspect of the invention, a method of producing a rail system is proposed, comprising the method of producing a fastening and support system for fastening and supporting a rail for rolling stocks such as trains of the predescribed kind, and a step of arranging at least one track on the fastening system.

According to a further aspect of the invention, use of a fastening system of the predescribed kind for fastening a rail for rolling stocks such as trains and/or use of a fastening and support system of the predescribed kind for fastening and supporting a rail for rolling stocks such as trains, is proposed.

The fastening system may be of the discrete fixation type (i.e. not of the floating type). The fastening system, in particular the elastic material may provide a linear or non-linear support (e.g. an inner portion of the elastic material under the base plate may be softer, in particular having a lower e-modulus than an outer portion). In addition or in the alternative to different e-moduli, there may be zones with a different (dynamic and static) stiffness (for example at least three different zones with different stiffness's) of the elastic material. This may allow a use for different vehicles according to a predicted axle load and deflection. The rigid casing may be used as fastening point or as a platform for different fastening systems. The rigid casing may be cast in (fresh concrete) and/or glued to concrete or to a steel surface or being anchored.

The elastic material may comprise for example (in particular for trams) Icosit KC 340 products and e.g. Sikaflex (as softest material). Alternatively, the elastic material (in particular for an underground train) may comprise Icosit KC 340 products and (e.g.) Sikaflex as a softest material. Alternatively, the elastic material (in particular for heavy trains) may comprise Icosit KC 340 products and (e.g.) Icosit KC products (as a softest material). In the alternative, the elastic material may comprise (in particular for light speed trains) Icosit KC 340 products and (e.g.) Icosit KC 340 products (as a softest material). Preferably, the abovementioned products are of the composition as of Feb. 1, 2017.

In general, the fastening system provides more resistance with respect to (in particular lateral) forces than systems of the prior art. Moreover, it may have a better distribution of loads, in particular due to a non-linear support (which could be calculated for different types of trains).

The base plate may be a separate part (being connected or connectable to the rail 10) with respect to the rail. A (maximum) thickness of the base plate may be (approximately) 0.2 times to 3 times of the (maximum) thickness of the elastic material (under the base plate). Moreover, the (maximum) thickness of the base plate may be 0.5 times to 3 times the (maximum) of the bottom plate of the rigid casing. The part of the elastic material between the bottom plate 16 of the casing and the base plate may be 0.6 to 4 times the (maximum) thickness of the bottom plate 16. In general, a plate-shape of the bottom plate 16 and/or the base plate 13 and/or the part of the elastic material between the bottom plate 16 and the base plate 13 should be understood as a shape having a (maximum) thickness which is less than 10%, in particular less than 5% of the (maximum) diameter and/or (maximum) edge length of the respective element.

BRIEF DESCRIPTION OF THE DRAWINGS

In the following, preferred embodiments of the present invention are described with reference to the drawings. These show.

DETAILED DESCRIPTION OF THE EMBODIMENT

Figure 1:
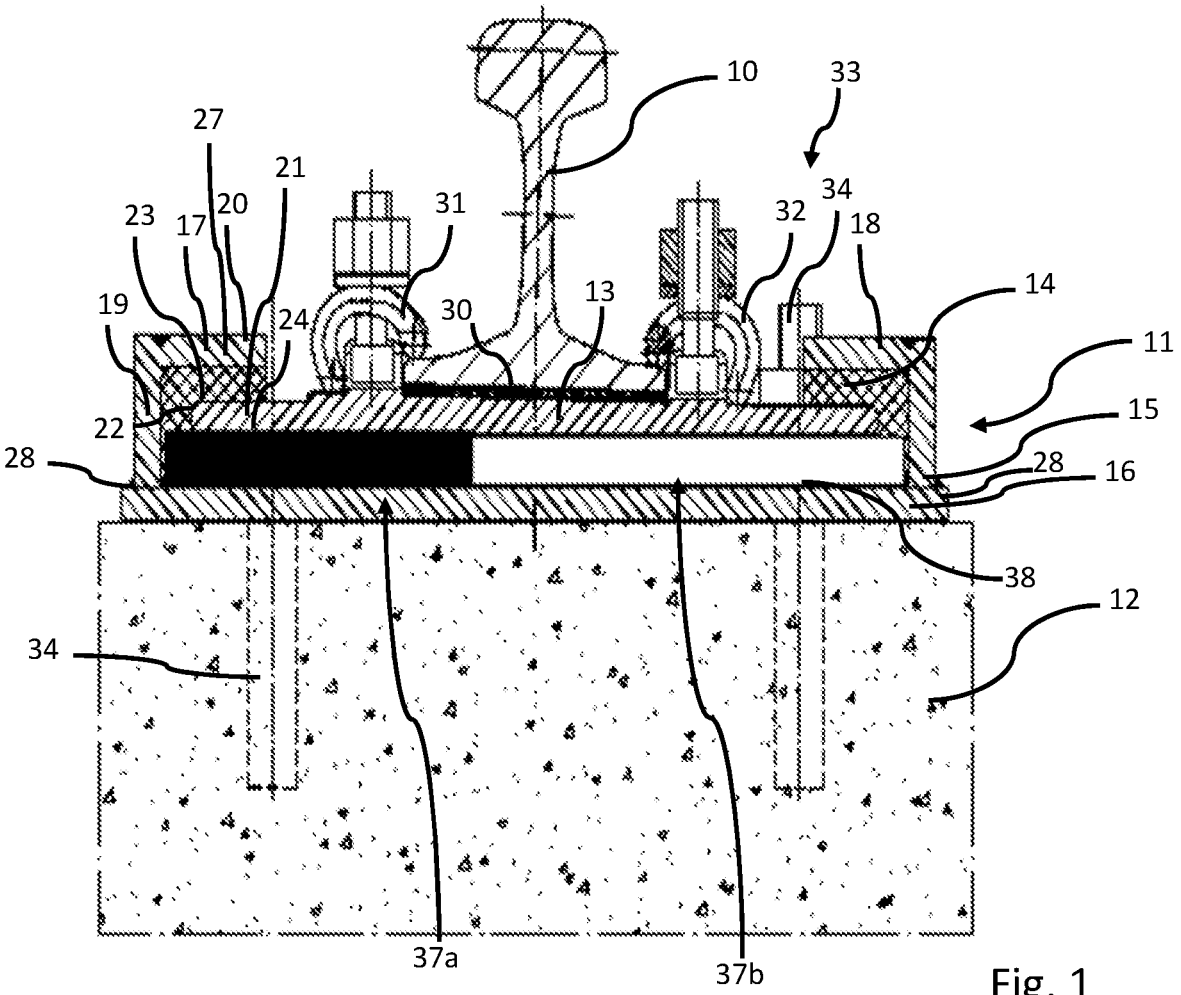
FIG. 1 A schematic cross-section of a rail system according to the invention.

FIG. 1 shows a rail system comprising a rail 10 fastened via a fastening system 11 to a support structure 12. The fastening system 11 comprises a base plate 13 (preferably of steel), an elastic material 14 (preferably based on polyurethane) and a solid casing 15 (preferably of steel). The solid casing 15 comprises a bottom plate 16 and a first rigid frame part 17 and a second rigid frame part 18. In the (transversal) cross-section of FIG. 1, first and second rigid frame part 17, 18 have an L-shape with one leg 19 perpendicular to the bottom plate 16 and one leg 20 in parallel to the bottom plate 16 and extending inwardly (in the direction of rail 10). A first edge portion 21 adjacent to a first edge 22 of the base plate 13 is encased by the first rigid frame part 17. In particular, the first edge 22, an upper surface 23 and a lower surface 24 face the first frame part 17 or the bottom plate 16, respectively. Moreover, (see FIG. 2) transversal edge portions 25*a* and 25*b* face the first rigid frame part 17 (or second rigid frame part 18, respectively).

Altogether, the first rigid frame part 17 comprises three walls 26*a*, 26*b* and 26*c* (having a rectangle between each other) and a cover wall 27. The second rigid frame part and the corresponding portions of the base plate and the elastic material may be structured as the first rigid frame part (mirrored).

Between the base plate 13 and the solid casing 15, the elastic material 14 is provided. The elastic material 14 contacts the (inner) surfaces of the solid casing 15 facing the base plate 13. Moreover, the elastic material 14 contacts the portions of the base plate 13 facing the solid casing 15. As a result, the outer surface of the elastic material 14 corresponds with the inner surface of the solid casing 15.

In the cross-section of FIG. 1 (transversal cross-section), the bottom plate 16 may have extensions 28 (on both sides) which extend beyond the first and second rigid frame part 17, 18, respectively. Moreover (see FIG. 2), the bottom plate 16 comprises extensions 29 which extend (in the longitudinal direction) beyond the first and second rigid frame part 17, 18, respectively. The bottom plate 16 (see FIG. 2) may have the form of a parallelogram (optionally with two cuts in two corners). Alternatively (which is indicated by the dotted lines), the bottom plate 16 may have the shape of a rectangle (again, optionally, with cuts in two corners). Between the rail and the base plate (see FIG. 1) a pad 30 can be provided. The rail 10 is connected with the base plate 13 via anchors 31, 32. Moreover, the rail 10 may be inclined (slightly) towards an inner (gauge) side 33.

Figure 2:
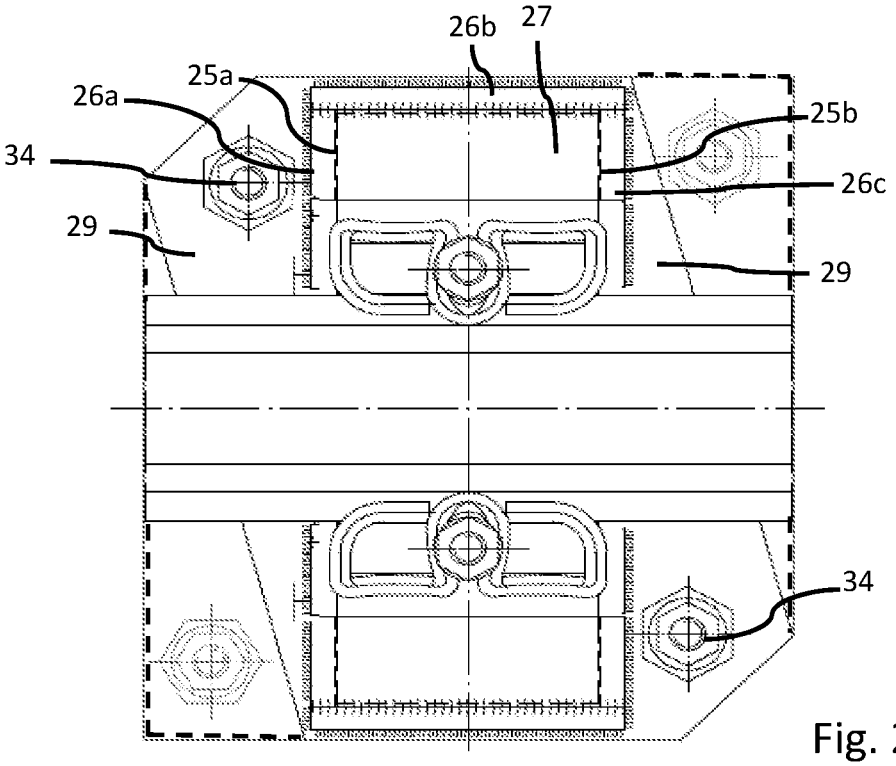
FIG. 2 An upper view of the rail system of FIG. 1.

In the embodiment of FIGS. 1 and 2, the solid casing 15 is connected with a support structure 12 via anchor devices 34 (which may comprise anchor screws).

Figure 3:
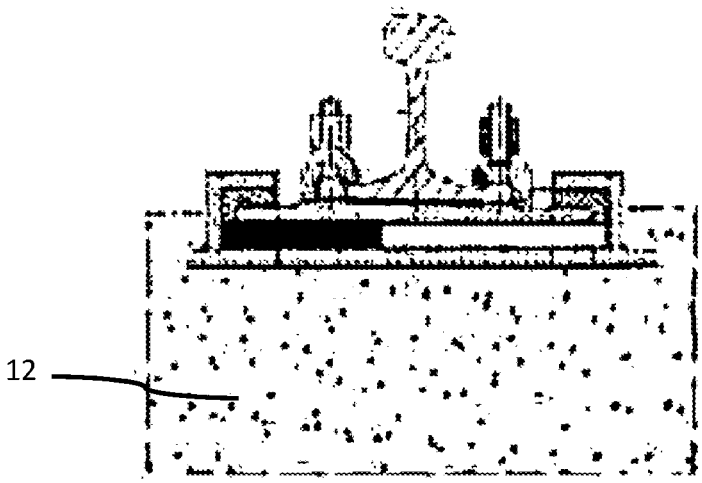
FIG. 3 A cross-section of an alternative embodiment of a rail system.

In the embodiment of FIG. 3, the fastening system 11 and rail 10 of FIGS. 1 and 2 is shown. In contrast to the embodiment of FIGS. 1 and 2, the fastening system is not connected via anchor devices to the support structure 12 (which may be, however 14, the case) but embedded in the support structure 12 (being preferably of concrete).

Figure 4:
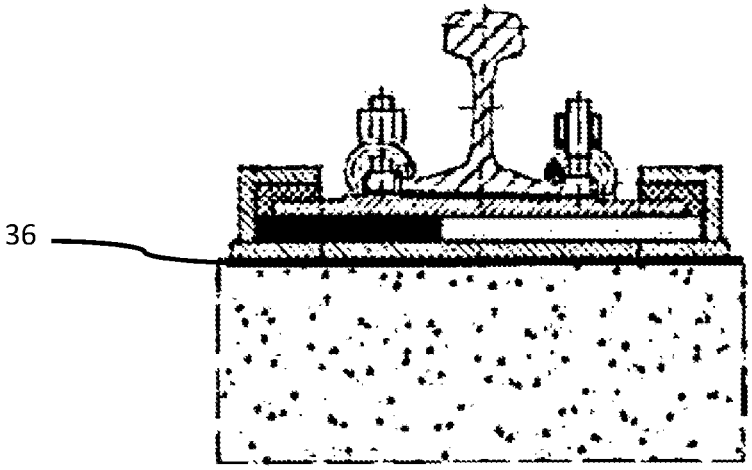
FIG. 4 A cross-section of a further alternative embodiment of the rail system.

FIG. 4 shows the fastening system 11 and rail 10 of FIGS. 1, 2 and 3. In the embodiment of FIG. 4, the fastening system 11 (namely the solid casing 15) is glued onto the support structure 12 via an adhesive 36.

In all embodiments, the elastic material 14 may comprise different zones 37*a*, 37*b* having a different e-modulus. In particular, the (in the figures white) zone 37*b* may have a lower e-modulus than the (in the figures black) zone 37*a*. Thereby, a non-linear support can be provided. Both portions 37*a*, 37*b* may extend over at least 25% of a bottom surface 38 of the elastic material 14. In the embodiments, the zone 37*b* is larger than the zone 37*a* (which is optional).

Figure 5:
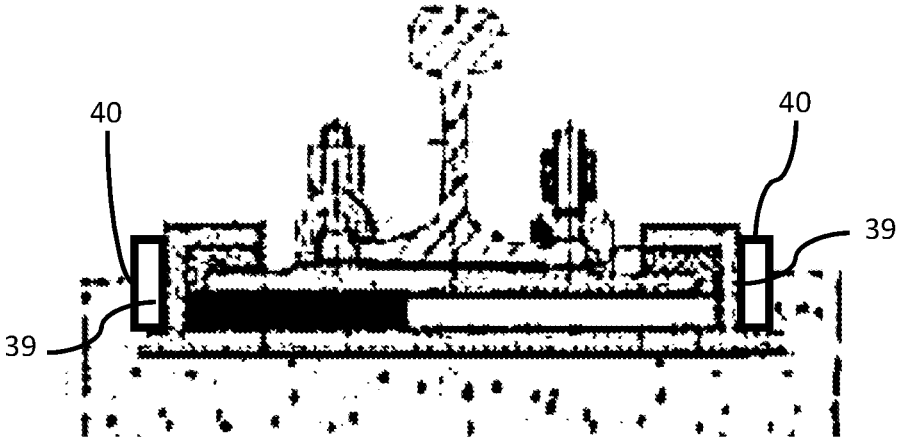
FIG. 5 A cross-section of an embodiment of the fastening system.

FIG. 5 shows a cross-section of an embodiment of the fastening system. This embodiment corresponds with the embodiments of FIGS. 1 to 4 except for an additional sealing material 40 at vertical sides 39. This embodiment is preferably embedded within concrete in order to seal a vertical connection of the fastening system and the concrete (against moisture; approx. 18'000 N/mm2 (Compressive) (According to ASTM D695-96) Tolerance of parameters +/−20%). The material 40 forms preferably an epoxy grouting system.

REFERENCE SIGNS

10 Rail
11 Fastening system
12 Support structure
13 Base plate
14 Elastic material
15 Solid casing
16 Bottom plate
17 First rigid frame part
18 Second rigid frame part
19 Leg
20 Leg
21 First edge portion
22 First edge
23 Upper surface
24 Lower surface
25*a* Transversal edge portion
25*b* Transversal edge portion
26*a* Wall
26*b* Wall
26*c* Wall
27 Cover wall
28 Extension
29 Extension
30 Pad
31 Anchor
32 Anchor
33 Inner side
34 Anchor device
36 Adhesive
37*a* Zone
37*b* Zone
38 Bottom surface
39 Vertical side
40 Sealing material

The invention claimed is:

1. A fastening system for fastening a rail for rolling stocks, comprising
a base plate,
an elastic material comprising at least two zones including a first zone that is at or closer to an inner side of the fastening system, and a second zone that is at or closer to an outer side of the fastening system, the first zone having a lower e-modulus than the second zone, and
a rigid casing,
wherein:
the base plate is embedded in the elastic material, and
the elastic material is arranged, at least partially, between the base plate and the rigid casing.

2. The fastening system of claim 1, wherein the rigid casing comprises at least one of: a rigid bottom surface, a first rigid frame part encasing a first edge portion of the base plate, and a second frame part encasing a second edge portion of the base plate.

3. The fastening system of claim 1, wherein the elastic material comprises at least one of: an elastic bottom surface, a first elastic frame part encasing a first edge portion of the base plate, and a second elastic frame part encasing a second edge portion of the base plate.

4. The fastening system of claim 1, wherein the elastic material covers at least one of: a lower surface of the base plate, one or two longitudinal edges of the base plate, one or more portions of one or two transversal edges of the base plate, and one or two portions of an upper surface of the base plate.

5. The fastening system of claim 1, wherein the rigid casing covers at least one of: a lower surface of the base plate, one or two longitudinal edges of the base plate, one or more portions of one or two transversal edges of the base plate, and one or two portions of an upper surface of the base plate.

6. The fastening system of claim 1, wherein the rigid casing covers at least one of: a lower surface of the elastic material, one or two longitudinal edges of the elastic material, one or more portions of one or two transversal edges of the elastic material, and one or two portions of an upper surface of the elastic material.

7. A fastening and support system for fastening and supporting a rail for rolling stocks, comprising the fastening system of claim 1 and a support structure.

8. The fastening and support system of claim 7, wherein the rigid casing is glued onto a surface of the support structure and/or the rigid casing is embedded in the support structure.

9. The fastening and support system of claim 7, wherein the fastening system is fixed to the support structure via at least one anchoring device.

10. A method of producing the fastening and support system according to claim 7, the method comprising:
embedding the base plate in the elastic material and arranging the elastic material, at least partially, between the base plate and the rigid casing, and
connecting the fastening system to the support structure.

11. A method of producing a rail system comprising:
performing the method according to claim 10, and
arranging at least one rail on the fastening system.

12. A method for fastening and supporting a rail for rolling stocks, the method comprising:
fastening and supporting the rail for rolling stocks with the fastening and support system according to claim 7.

13. A rail system comprising
the fastening system according to claim 1, and
at least one rail.

14. The rail system according to claim 13, wherein the rail system comprises the support structure.

15. A method of producing the fastening system according to claim 1, the method comprising:
embedding the base plate in the elastic material and arranging the elastic material, at least partially, between the base plate and the rigid casing.

16. A method for fastening a rail for rolling stocks, the method comprising:
fastening the rail for rolling stocks with the fastening system of claim 1.

* * * * *